United States Patent [19]

Heider

[11] Patent Number: 4,968,928

[45] Date of Patent: Nov. 6, 1990

[54] METHOD AND ARRANGEMENT FOR SUPPRESSING NOISE SIGNALS IN A LOAD SUPPLIED WITH DIRECT VOLTAGE BY A FINAL CONTROLLER

[75] Inventor: Siegfried Heider, Backnang, Fed. Rep. of Germany

[73] Assignee: ANT Nachrichtentechnik GmbH, Backnang, Fed. Rep. of Germany

[21] Appl. No.: 421,231

[22] Filed: Oct. 13, 1989

[30] Foreign Application Priority Data

Oct. 13, 1988 [DE] Fed. Rep. of Germany ..... 3834880

[51] Int. Cl.[5] ..... G05F 1/46; G05F 1/56; H03F 3/58

[52] U.S. Cl. ..... 323/275; 323/280; 363/89

[58] Field of Search ..... 323/273, 274, 275, 276, 323/277, 280; 363/89

[56] References Cited

U.S. PATENT DOCUMENTS

| | | | |
|---|---|---|---|
| 3,916,294 | 10/1975 | Kennedy | 323/275 |
| 3,939,399 | 2/1976 | Funatsu et al. | 323/275 |
| 4,327,319 | 4/1982 | Swisher et al. | 323/275 |
| 4,644,254 | 2/1987 | Panse | 363/89 |

FOREIGN PATENT DOCUMENTS 2822897 11/1979 Fed. Rep. of Germany .

OTHER PUBLICATIONS

Article from German Periodical Funk-Technik, [Radio Technology] Entitled "Schaltungs-Technik Moderner Netzgerate" vol. 37, No. 9, (1982), pp. 385-388.

Publication-*Electronics,* Article entitled "Linear Controller Attenuates Switching-Supply Ripple", by Christopher S. Tocci Oct. 6, 1982, pp. 110-111.

French Publication *Revue de Physique Appliquee, Entitled "Improvement of the Ripple of a High Voltage Power Supply for a Field Emission Gun", by M. Troyon, E. Merienne, vol. 9, No. 3, pp. 533-537 (May 1974).*

*Primary Examiner*—Peter S. Wong

*Attorney, Agent, or Firm*—Spencer & Frank

[57] ABSTRACT

A method and arrangement for suppressing noise having an alternating voltage component in a load supplied with a direct voltage signal by way of a control loop including a final controller connected to the load. The final controller is connected to the load by way of only an ohmic resistor. The signal at the output of the final controller contains an alternating voltage component of the noise. A signal proportional to the alternating voltage component of the noise in the load is formed in a branch circuit separate from the control loop supplying the load. The proportional signal is fed in phase opposition to the signal appearing at the output of the final controller ahead of the ohmic resistor with an amplitude corresponding to the amplitude of the alternating voltage component of the noise dropped across the ohmic resistor.

5 Claims, 1 Drawing Sheet

METHOD AND ARRANGEMENT FOR SUPPRESSING NOISE SIGNALS IN A LOAD SUPPLIED WITH DIRECT VOLTAGE BY A FINAL CONTROLLER

CROSS REFERENCE TO RELATED APPLICATION

This application claims the priority of Application Ser. No. P 38 34 880.2, filed Oct. 13, 1988, in the Federal Republic of Germany, the subject matter of which is incorporated herein by reference.

BACKGROUND OF THE INVENTION

The present invention relates to a method of suppressing noise having an alternating voltage component in a load supplied with a direct voltage signal by way of a control loop including a final controller connected to the load, and to an arrangement for implementing the method.

In many cases, loads are supplied with direct voltage by way of a final controller, for example the final controller of a series controller as disclosed in German laid-open Patent Application No. DE-OS 2,822,897, and "Funk Technik" [Radio Technology] Vol. 37, No. 9 (1982), pp. 385–388. Voltage fluctuations in the supply source, fluctuations in the load and noise signals, for example mains hum, can be eliminated with the use of such a final controller.

The publication "Electronics", Oct. 6, 1982, pages 110–111, discloses the connection of a controlled choke subsequent to a switch controller in order to suppress alternating voltage (ripple) noise signals. By way of a capacitive sensor, the circuit disclosed there detects the load voltage (direct and alternating components) and feeds it to a differential amplifier. The alternating component appearing at the output of the differential amplifier is added to the choke in phase opposition to the alternating component of the load voltage. It is difficult to suppress low-frequency ripple with such an arrangement. Fast changes in current at the output, as they occur, for example, in TDMA satellite systems, cause considerable overshooting.

The publication "Revue de Physique Appliquée", Vol. 9, May, 1974, pages 533–537, discloses, for a high voltage direct current supply system, the connection of a differential amplifier by way of a capacitive voltage divider with a load terminal in order to reduce noise voltage and to feed the output signal of the differential amplifier, in phase opposition, to a control input of the high voltage generator.

SUMMARY OF THE INVENTION

It is an object of the present invention to provide a method which substantially suppresses any remaining alternating voltage components of noise in a load supplied with a direct voltage by a final controller and to do so in a cost effective manner.

It is a further object of the invention to provide an arrangement for implementing this method.

The above and other objects are accomplished according to the invention by the provision of a method of suppressing noise having an alternating voltage component in a load supplied with a direct voltage signal by way of a control loop including a final controller connected to the load including the steps of: forming a connection between the final controller and the load by way of only an ohmic resistor, the signal at the output of the final controller containing an alternating voltage component of the noise; forming a signal proportional to the alternating voltage component of the noise in the load in a branch circuit separate from the control loop supplying the load; and feeding the proportional signal in phase opposition to the signal appearing at the output of the final controller ahead of the ohmic resistor with an amplitude corresponding to the amplitude of the alternating voltage component of the noise dropped across the ohmic resistor.

In another aspect of the invention, there is provided an arrangement for suppressing noise having an alternating voltage component in a load having first and second terminals, including: a voltage source supplying a direct voltage; a control loop including a final controller connected between the voltage source and the first terminal of the load for supplying the load with a direct voltage signal at the output of the final controller; an ohmic resistor forming the sole connecting element between the output of the final controller and the first terminal of the load; a capacitive sensor connected with the second terminal of the load for developing a voltage proportional to an alternating voltage component of noise in the load; and a differential amplifier having an inverting input connected with the capacitive sensor and an output connected to the output of the final controller ahead of the ohmic resistor, the differential amplifier producing an alternating voltage at its output which is in phase opposition with, and corresponding in amplitude to, an alternating voltage component of the noise across the ohmic resistor.

The present invention is based on the realization that noise signals or noise signal components, particularly "alternating voltage ripple", which flow to ground past the final controller of the series controller, for example by way of the parasitic capacitances of a high voltage transformer, cannot be eliminated by conventional final controllers/regulators. The load voltage, for example the helix voltage of a traveling wave amplifier, thus continues to be charged with this type of noise signal. The measures of the present invention effectively suppress such a noise signal.

If the controller is connected to a controlled choke as suggested in the "Electronics" publication above, low frequency noise components are difficult to suppress. Moreover, the suppression of relatively low frequency noise components requires the provision of a large inductance which, in satellite applications, cannot be employed due to its weight. In the method according to the present invention, inductive components are not required for the suppression of noise signals. In the realization according to the "Electronics" publication, the voltage drop across the direct current resistor of the choke cannot be eliminated at all and thus noise signal suppression cannot be as effective as in the method according to the invention. Another advantage of the method according to the invention is the fact that the gain of the final controller is included in the ripple suppression. A capacitor provided as a component of an output filter can be employed as the capacitive sensor to detect the noise signal so that no further capacitive components are required.

BRIEF DESCRIPTION OF THE DRAWINGS

The invention will now be described in greater detail with reference to the drawing figures.

DETAILED DESCRIPTION OF THE PREFERRED EMBODIMENTS

Figure 1:
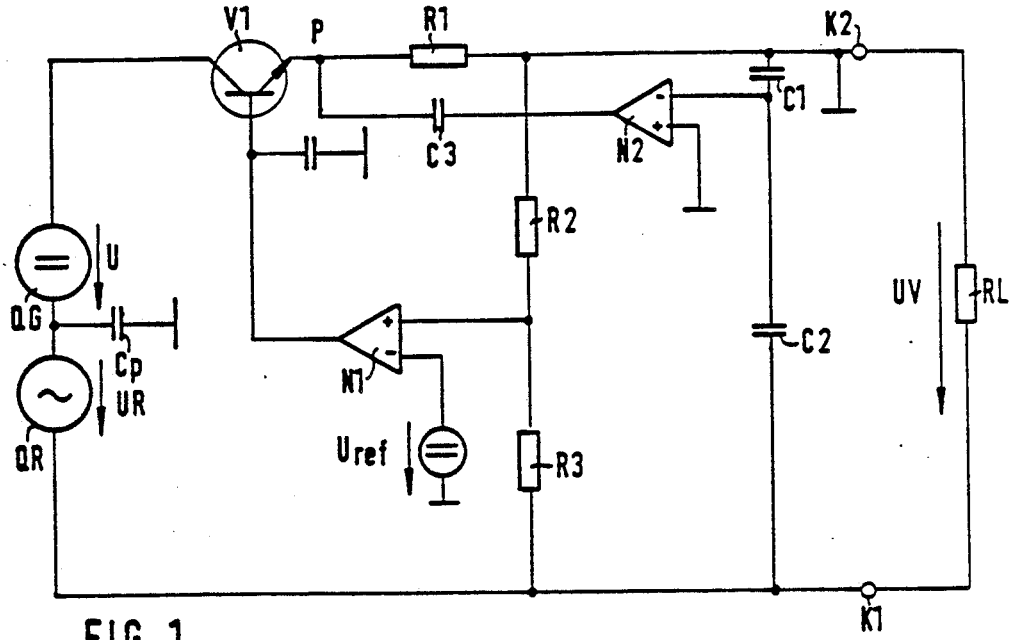
FIG. 1 is a basic circuit schematic for implementing the method according to the invention.

Referring to FIG. 1, there is shown a direct voltage supply QG producing a direct voltage U for supplying a load RL with direct voltage. Superposed on the direct voltage U is a noise voltage, alternating voltage ripple UR. FIG. 1 shows a separate voltage source QR for this alternating voltage ripple UR. The load RL is supplied with direct voltage by way of a final controller, comprising a transistor V1, and a resistor R1 connected in series with the collector-emitter path of transistor V1. A terminal K2 of load RL is connected to transistor V1 by way of only resistor R1. A voltage divider composed of resistors R2 and R3 connected in parallel with load RL detects a voltage which is proportional to voltage UV across load RL and is fed to an operational amplifier N1. Operational amplifier N1, which operates as differential amplifier, compares the voltage detected by voltage divider R2, R3 with a reference voltage Uref. The output signal of operational amplifier N1 serves to control transistor V1. Transistor V1, resistors R1, R2 and R3 as well as operational amplifier N1 operate as a conventional series controller. Operational amplifier N1 has an upper limit frequency of about 3 kHz. An assumed alternating voltage ripple of 5V is suppressed by the series controller down to 100 to 500 mV.

If, however, part of the alternating voltage ripple is able to flow off to ground via a parasitic capacitance Cp, shown in FIG. 1 connected between a common terminal of direct voltage source QG and noise signal source QR, on the one hand, and reference potential to ground on the other hand, a ripple voltage proportional to capacitance Cp drops across load RL since the load terminal K2 connected via resistor R1 with the transistor V1 is at ground potential. Load terminal K1, which is not connected to transistor V1, is connected via a capacitive sensor C2 with the inverting input of an operational amplifier N2. The non-inverting input of operational amplifier N2 is connected with ground potential. Thus, by way of capacitive sensor C2, the alternating voltage ripple flowing out through parasitic capacitance Cp is detected and fed to operational amplifier N2 which operates as differential amplifier. The difference voltage at the input of operational amplifier N2 is inverted and fed in phase opposition with respect to the alternating component appearing at the output of transistor V1 to the connecting point P between transistor V1 and ohmic resistor R1 which constitutes the working resistor for operational amplifier N2.

Advantageously, a capacitor which may be provided in any case as a component of a high voltage smoothing filter can be employed as the capacitive sensor so that no additional capacitor is required.

In the ideal case, a voltage proportional to the alternating voltage ripple appears at the output of operational amplifier N2. The direct voltage across resistor R1 generated by the load current is isolated from the output of operational amplifier N2 by a capacitor C3.

A capacitor C1 may be connected between the inverting input of operational amplifier N2 and terminal K2. This capacitor, together with capacitor C2, acts as a capacitive voltage divider for the alternating voltage ripple. With a limit frequency of about 50 kHz for differential amplifier N2, the alternating voltage ripple is suppressed down to 10 to 50 mV. The HF component of the alternating voltage ripple that cannot be eliminated by means of differential amplifier N2 is able to flow off via capacitor C1. Differential amplifier N2 is operated with almost an open gain. If a capacitor having the same capacitance as capacitor C2 is provided in the feedback branch of the differential amplifier, differential amplifier N2 can be operated with a gain of V=1. The alternating voltage signal furnished by differential amplifier N2 at point P must, in any case, correspond in amplitude to the alternating voltage component dropped across resistor R1. Then the alternating voltage components optimally compensate one another due to their phase opposition.

Although a separate control loop is provided for suppression of the alternating voltage noise signal, the gain of the final controller is included in the suppression of the alternating voltage noise signal so that the suppression factor becomes very high.

Figure 2:
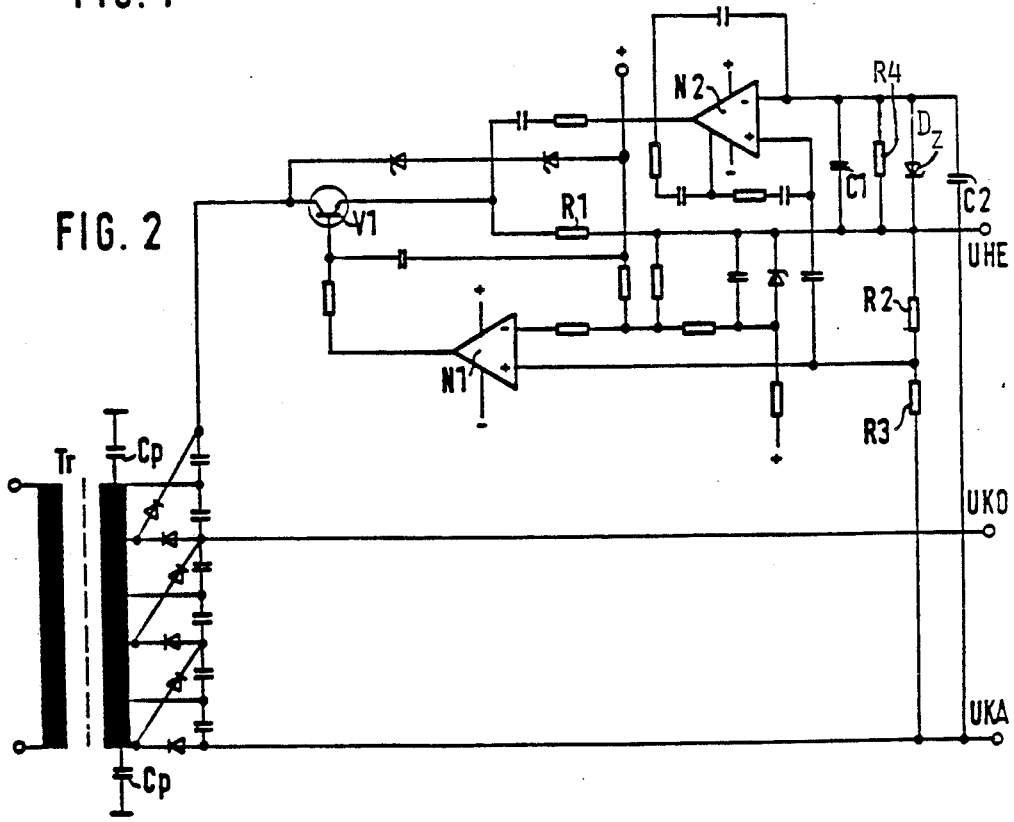
FIG. 2 shows the use of the invention in a helix voltage regulator of a traveling wave amplifier current supply.

FIG. 2 shows the use of the present invention in a traveling wave amplifier current supply in the form of a helix voltage regulator. A high voltage is generated by means of a high voltage transformer Tr, for example in a switch controller connected ahead of high voltage transformer Tr. By way of several secondary taps, the supply voltages for a cathode UKA, a collector or collectors UKO and a helix UHE are obtained from this high voltage after rectification. The helix voltage is detected by voltage divider R2, R3 and regulated to a predetermined desired value by way of operational amplifier N1 and the final controller, transistor V1. The alternating voltage ripple, e.g. the switching ripple of the switch controller, flowing via the parasitic transformer capacitances to ground is detected by capacitive voltage divider C1, C2, inverted in operational amplifier N2 and is eliminated at the output of the final controller, transistor V1, by feeding the inverted signal to resistor R1. It is advantageous to operate fast operational amplifiers N2 with a gain of 1.

It is also possible to detect only part of the alternating voltage ripple, for example the ripple at only one secondary winding of high voltage transformer Tr and forward it to operational amplifier N2.

The circuit composed of a resistor R4 and a Zener diode $D_z$ provided between the inputs of operational amplifier N2 serves to protect this operational amplifier.

The present invention is particularly suitable for the suppression of ripple when supplying helix current to traveling wave amplifiers onboard satellites.

The present invention is able to suppress low frequency noise signals starting at about 100 Hz without requiring any inductive components. Since no inductive components are employed for evaluation of the noise signal, no changes in phase occur. Thus the present invention is also suitable for systems in which rapid changes in current occur at the output, for example in TDMA satellite systems.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A method of suppressing noise having an alternating voltage component in a load supplied with a direct voltage signal by way of a control loop including a final controller connected to the load, comprising:

forming a connection between the final controller and the load by way of only an ohmic resistor, the signal at the output of the final controller containing an alternating voltage component of the noise;

forming a signal proportional to the alternating voltage component of the noise in the load in a branch circuit separate from the control loop supplying the load; and feeding the proportional signal in phase opposition to the signal appearing at the output of the final controller ahead of the ohmic resistor with an amplitude corresponding to the amplitude of the alternating voltage component of the noise dropped across the ohmic resistor.

2. An arrangement for suppressing noise having an alternating voltage component in a load having first and second terminals, comprising:

a voltage source supplying a direct voltage;

a control loop including a final controller connected between said voltage source and the first terminal of the load for supplying the load with a direct voltage signal at the output of said final controller;

an ohmic resistor forming the sole connecting element between the output of said final controller and the first terminal of the load;

a capacitive sensor connected with the second terminal of the load for developing a voltage proportional to an alternating voltage component of noise in the load;

a differential amplifier having an inverting input connected with said capacitive sensor and an output connected to the output of said final controller ahead of said ohmic resistor, said differential amplifier producing an alternating voltage at its output which is in phase opposition with, and corresponding in amplitude to, an alternating voltage component of the noise across said ohmic resistor.

3. An arrangement as defined in claim 2, wherein said differential amplifier comprises an inverting amplifier.

4. An arrangement as defined in claim 2, and further comprising a capacitor having one terminal connected at a point between the first terminal of the load and said ohmic resistor and another terminal connected to the inverting input of said differential amplifier, said capacitor and said capacitive sensor forming a capacitive voltage divider.

5. A method of using the arrangement as defined in claim 2 for suppressing a noise signal having an alternating voltage component in a traveling wave amplifier having a helix input supplied with a direct voltage from a high voltage transformer, comprising:

connecting the input of the final controller to a rectified output of the transformer, the rectified output of the transformer constituting the voltage source; and connecting the ohmic resistor to the helix input of the traveling wave amplifier, the helix constituting the load.

* * * * *